United States Patent [19]

Kluthe

[11] 4,177,900

[45] Dec. 11, 1979

[54] GRAIN SCALPING AND CLEANING APPARATUS AND METHOD

[76] Inventor: Eldon R. Kluthe, Cairo, Nebr. 68824

[21] Appl. No.: 929,481

[22] Filed: Jul. 31, 1978

[51] Int. Cl.[2] ..... B07B 1/04

[52] U.S. Cl. ..... 209/247; 209/261; 209/316; 209/358

[58] Field of Search ..... 209/261, 263-265, 209/316-317, 352-353, 356, 358, 247

[56] References Cited

U.S. PATENT DOCUMENTS

| | | | |
|---|---|---|---|
| 157,415 | 12/1874 | Parker | 209/316 |
| 353,658 | 12/1886 | Beardslee | 209/358 |
| 417,836 | 12/1889 | Ponsar | 209/358 |
| 2,053,038 | 9/1936 | MacKenzie | 209/358 |
| 2,420,941 | 5/1947 | Fies | 209/358 |

*Primary Examiner*—William A. Cuchlinski, Jr.
*Assistant Examiner*—Jon E. Hokanson
*Attorney, Agent, or Firm*—William D. West

[57] ABSTRACT

A grain scalping and cleaning apparatus for removing impurities in grain according to size is disclosed. The apparatus includes multiple grain movement paddles moving relative to appropriate screens. An endless chain drives the grain movement paddles. Both large and small impurities are separated from the grain through the use of the screens and paddles with the aid of gravity. A method for removing impurities in grain is also disclosed.

27 Claims, 7 Drawing Figures

GRAIN SCALPING AND CLEANING APPARATUS AND METHOD

BACKGROUND OF THE INVENTION

1. Field of Invention

The present invention relates generally to a grain scalping and cleaning apparatus and method and in particular to the type employing grain movement paddles which move grain against at least one screen whereby impurities are removed.

2. Prior Art

Since the earliest times, it has been recognized that grain should be as free of impurities as possible. Removal of impurities not only improves the quality of a crop, but also maximizes the crop yield when foreign seeds and weeds are eliminated. Removing impurities also contributes to an improvement in the storage duration of the grain.

Initially, individual farmers could manually clean grain by using sieves. However, as agricultural labor became less available efficiency in grain cleaning became paramount. In addition, population increases and the subsequent market for greater quantities of grain and seed demanded the use of better means for cleaning grain.

One of the early attempts to free farmers from manual grading and cleaning of grain was Beardslee's grain grader, U.S. Pat. No. 353,658. Although this invention improved grading techniques, the need for a cleaner grain product persisted. Beardslee's apparatus also limited the volume of grain which could be graded.

Another attempt to meet agriculture's need for a means to clean agricultural material and in particular cotton seeds, was Mackenzie's apparatus for separating and cleaning material, U.S. Pat. No. 2,053,038. Although Mackenzie's cleaner could process a greater quantity of material at one time than Beardslee's invention, the increased complexity of Mackenzie's machine brought about new problems. Machine size was prohibitive as a result of the number of gears, chains and conveyors used, and the position at which the machine could be utilized was restricted to a flat, level surface. Because of the machine's complex design, maintenance became difficult as well as time consuming.

Today's needs of both agriculture and its market require not only cleaned grain, but also quantities unknown and unimagined at the time of Mackenzie's invention. The individual farmer must utilize cleaning means which are not only efficient in terms of dollars and bushels, but just as important, such means must be simple in design and easily maintained. The present invention fulfills all of these needs.

Large impurities in grain must be removed in order not to spread insect infestation to other localities. As an example it has been discovered that the spread of the European Corn Borer can be effectively reduced by removing foreign matter of a diameter larger than ½" in corn. This process of large impurities removal is known as "scalping" whereas the process of removing fine impurities, dust and small particles is known as "cleaning". The present invention will both "scalp" and "clean" grain simultaneously.

With its inter-connecting sections, the user can quickly increase or decrease the volume of grain processed. In addition, the user is not restricted to use of the machine on the ground, but can suspend it in the air or at an angle to meet almost any location demand. And furthermore, the removability of the screens will allow the individual user the added advantage of scalping and cleaning many different grains.

Not only is the present invention simple in design and therefore relatively maintenance free, but it is extremely versatile and able to meet the varying needs of each individual user, including farmers, elevator operators, grain shippers and others.

The present invention thus meets the need for a simple, efficient, high volume grain cleaning apparatus that will remove both large and small impurities in grain.

SUMMARY OF THE INVENTION

The principal objective of the present invention is to provide an apparatus and method for the removal of foreign material of grain.

Another objective of the present invention is to provide a grain cleaning apparatus with an elongated variable sized grading and cleaning screen.

Still another primary objective of the present invention is to provide the user with a grain cleaning apparatus which can be quickly and easily modified in its length to meet varying volume requirements.

A further objective of the present invention is to provide an apparatus and method for cleaning grain which utilizes grain movement paddles which are specially notched and positioned with regard to each other and operate in a position transverse to the flow of the grain as it moves along and against the screens of the apparatus.

Another objective of the present invention is to provide a grain cleaning apparatus having an endless chain drive easily adapted to a variety of power units.

A still further important objective is to provide a durable grain cleaning apparatus which is not restricted to use only on the ground or a building floor, but which can be used when suspended above the ground or floor.

Another object of the present invention is to provide a grain cleaning apparatus having impurity removing screens to remove debris not only larger than the grain itself, but also impurities which are finer than the grain being cleaned.

Another object of the invention is to provide an apparatus and method which will remove impurities of a diameter of ½" or greater in corn in order to meet the requirements for the European Corn Borer Certificate necessary for shipment to certain localities.

A still further object of the invention is to provide a variable grain cleaning apparatus having separate and distinct outlets for the removal of both fine and coarse impurities.

Other objects, advantages and novel features of the present invention will become apparent from the following detailed description of the invention when considered in conjunction with the accompanying drawings.

BRIEF DESCRIPTION OF THE DRAWINGS

For a better understanding of the invention as well as other objects and further features thereof, reference is made in the following detailed disclosure of the invention to with the accompanying drawings wherein.

DESCRIPTION OF THE PREFERRED EMBODIMENT

Figure 1:
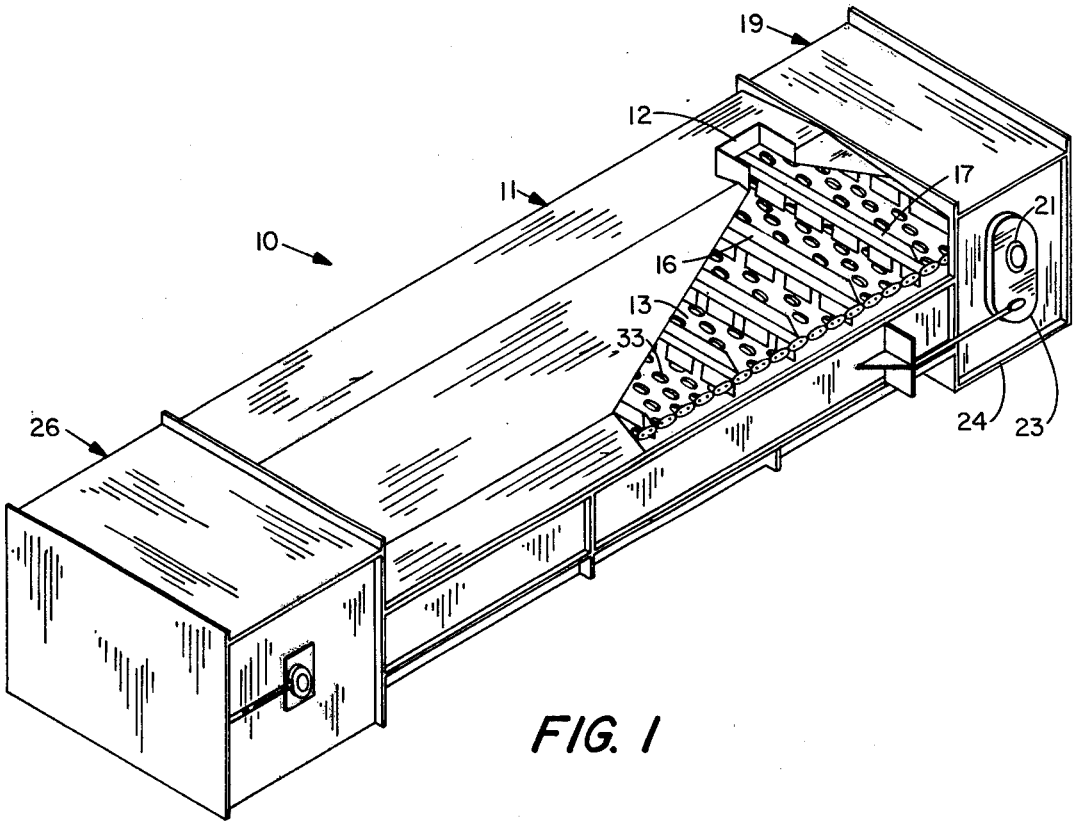
FIG. 1 is a cut-away perspective view of the grain cleaning apparatus.
Figure 2:
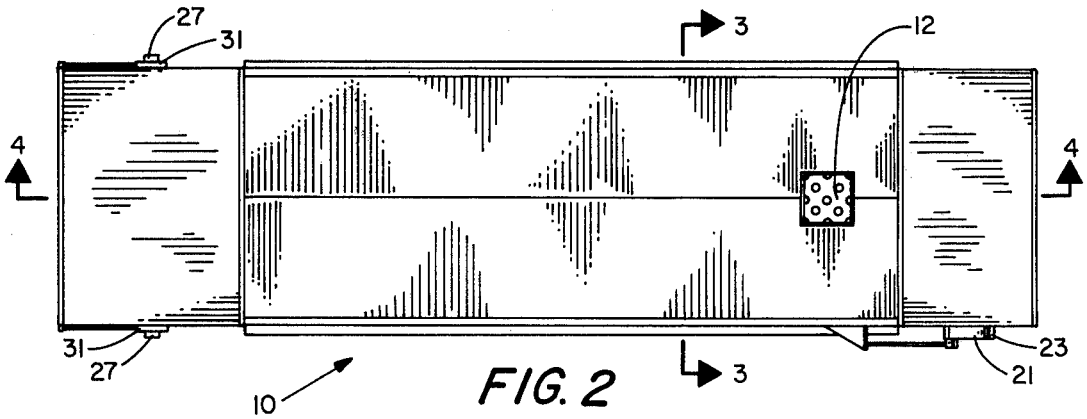
FIG. 2 is a top plan view of the invention.

The grain cleaning apparatus as shown in FIG. 1 and as depicted generally by the numeral 10, can be viewed as having basically three operating units, a main screen housing unit 11, an impurity discharge unit 26 and a clean grain discharge unit 19. The main screen housing unit 11 can be designed in such a way as to be easily accessible. Obviously, various designs would be available to accomplish this purpose. In the present embodiment, the housing unit 11 has an upper portion which rests in place between impurity discharge unit 26 and clean grain discharge unit 19 by the force of its own weight as shown in FIG. 1. The upper portion of the housing unit 11 can be manually lifted and removed from the apparatus to expose the internal parts for maintenance and repair, removal or replacement of screens, or some other purpose.

Figure 4:
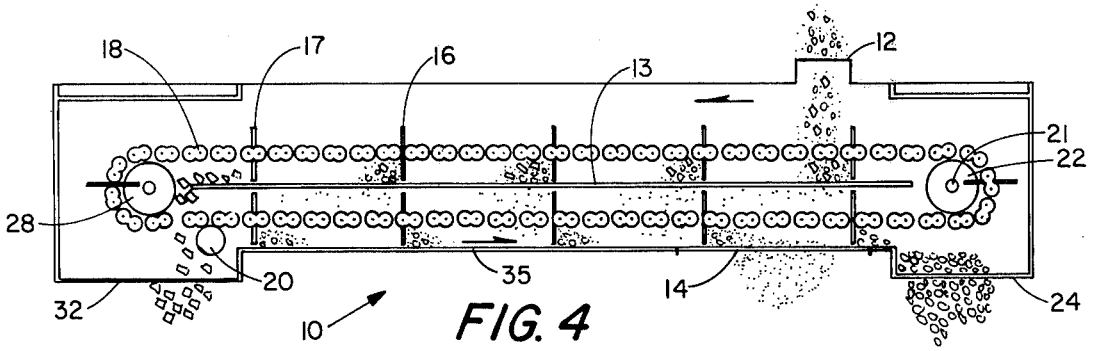
FIG. 4 is a side elevation sectional view of the invention taken substantially along line 4—4 in FIG. 2.

Inlet 12 is provided on the end of the screen housing unit 11 through which the uncleaned grain enters the apparatus is shown in FIG. 1 and 4 on the top side of the elongated screen housing unit 11. The screen housing unit 11 houses both a primary screen 13 and a fine screen 14 as shown in FIG. 1. Doors (not shown) can be provided along the bottom of the unit immediately below the fine screen 14 to facilitate the control the volume of fine material removed. Sufficient space as shown in FIG. 4 is provided within the unit to allow a succession of grain movement paddles 16 and 17 attached to an endless chain drive 18 to move the grain and debris along and against the screens 13 in one direction and screen 14 in the other. Primary grain movement paddles 16 are provided that contain fice notches and secondary paddles 17 are provided having four notches 30 for purposes which will be further explained below.

Also, the screen housing unit 11 allows for the connection of a plurality of such elongate units in multiple sections. Size requirements will vary with the individual purchaser and the ability to adjust the length of the screen housing unit 11 in selections provides for variance in the volume of the grain to be cleaned. Various combinations of apparatus length and motor speed will allow whatever quantity of grain cleaned which the individual situation demands.

Attached at the upper end of the main housing unit 11 is the drive means unit depicted generally as 19. The drive means unit 19 houses a shaft 21 to which is attached sprocket wheels 22. A motor 23 is operably connected to shaft 21 and motor 23 can be any small horsepower motor.

Figure 7:
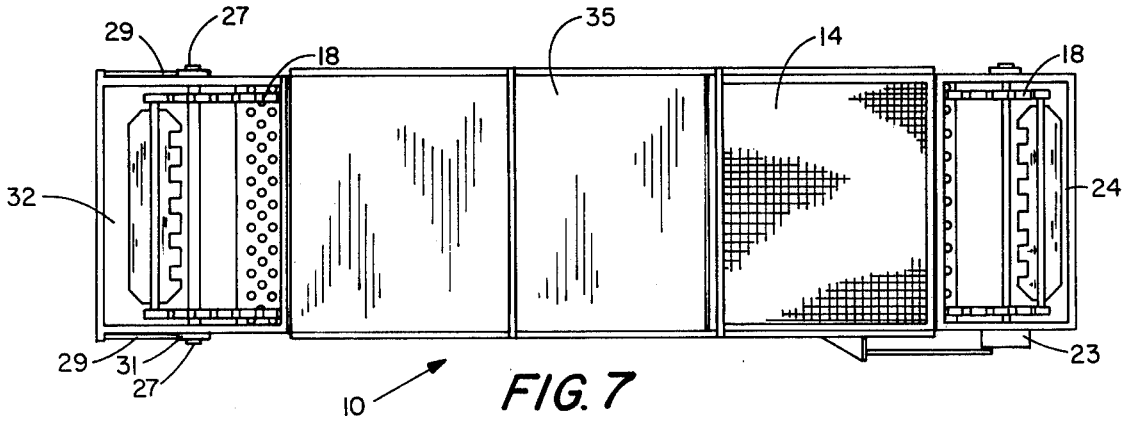
FIG. 7 is a bottom plan view of the invention.

Positioned along the sprocket wheel 22 is the endless link chain 18 to which are attached the paddles 16 and 17 described above. At the base of the drive means unit is the outlet 24 as shown in FIG. 7 through which the cleaned grain is finally discharged.

At the lower and opposite end of the main housing unit 11 is attached the overs discharge unit depicted generally as 26. Within this unit 26 are a shaft 27 and sprocket wheels 28 attached to the shaft 27. Positioned along and over the sprocket wheels 28 is the endless chain 18. As shown in FIG. 7, a chain tightening adjustment 29 is provided in order to vary the tension in the endless chains 18. The chain adjustments 29 are comprised of two horizontally disposed bolts attached to a pair of adjustable bearing plates 31. Horizontal slots (not shown) are provided in the opposite sides of the overs discharge unit 26 and permit the shaft 27 to move translationally with respect to shaft 21. Nuts (not shown) are tightened on the bolts of the adjustment means 29 in order to vary the position of the shaft 27 translationally with respect to shaft 21. Translation movement of shaft 27 away from shaft 21 tightens the endless chains 18. Idler sprockets 20 are positioned under the chain and near the sprocket wheels 28 to support the chain and paddles positions relative to the fine screen. Located at the base of the overs discharge unit 26 is an outlet 32 as shown in FIG. 7 through which the debris or overs unable to pass through the primary screen is discharged out the apparatus.

The invention can be mounted upon a trailer (not shown) or suspended in a position above the ground or in whatever manner the user requires.

The operation of the machine is as follows. The grain enters the cleaning apparatus 10 through the inlet 12 located at the upper end on the top side of the main housing unit 11 as shown in FIG. 1. Upon entering the unit, the grain falls directly upon the primary screen 13.

The primary screen 13 is generally metal having vertically and horizontally aligned rows of closely spaced punched holes or wire mesh of an appropriate diameter. In one embodiment, the punched holes each have a diameter of ½" or less. With the use of ½" diameters, cleaned corn will meet the requirements for European Corn Borer Certification. Depending on the intended use of the cleaned grain, the screen 13 can be removed and replaced to provide whatever diameter of screen holes required. The primary screen 13 in conjunction with the paddles 16 and 17 functions in a sieve-like manner. The grain and debris which are able to pass through the screen's holes fall to the fine screen 14 located in the lower portion 35 of the main housing unit 11. The larger debris, generally containing insects, rocks, sticks, etc., remains on the primary screen and is swept along by the paddles to an overs discharge outlet 32 located at the base of the end unit 26 where it is discharged by the use of gravity.

Figure 3:
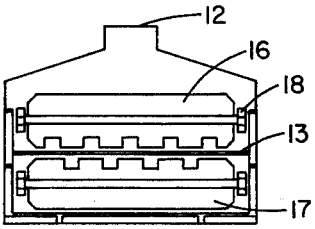
FIG. 3 is an end sectional view of the invention taken substantially along line 3—3 in FIG. 2.
Figure 5:
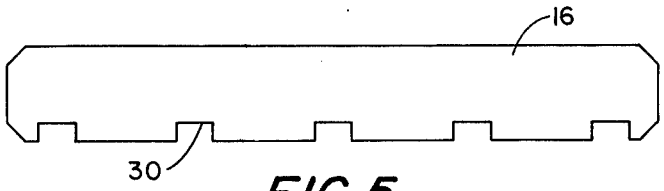
FIG. 5 is a side elevation view of one of the grain movement paddles.
Figure 6:
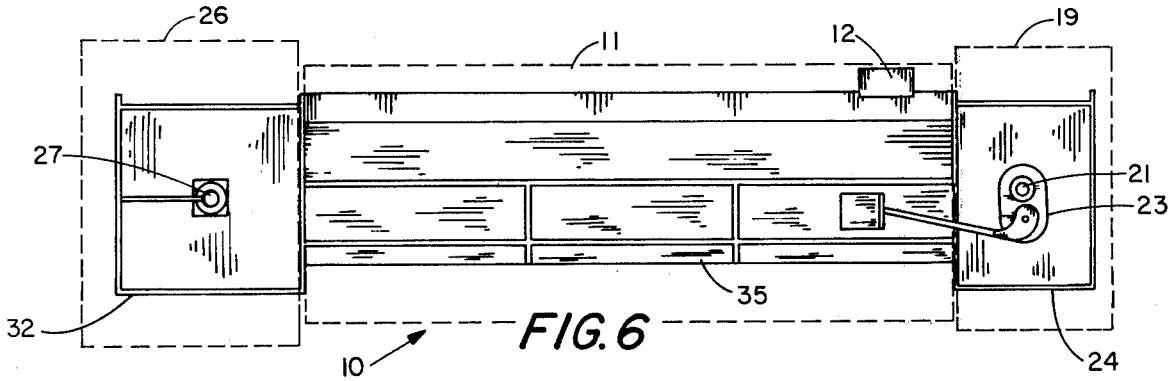
FIG. 6 is a side elevational view of the invention.

The uncleaned grain is moved along the primary screen 13 by a continuous succession of paddles shown in FIG. 4. The paddles are constructed of a strong polyurethane plastic. Each paddle 16 and 17 is positioned transversely to the direction of the flow of the grain moving over the screen 13 as shown in FIG. 4. The length of each paddle is substantially the width of the main housing unit 11. Both ends of a paddle are affixed to an endless link chain 18. The chain 18 provides the drive means for moving the paddles along and against the screen 13 in a sweeping manner. The upper one-half portion of each paddle being a solid expanse of plastic with the lower one-half portion is of the same plastic having either four or five notches along its edges as shown in FIGS. 3 and 5.

A unique feature of the present invention is the provision for every other paddle in the succession to have four notches with the paddle directly in front and directly behind it having five notches. The notches of the four notch paddles align with the notches of the other four notch paddles. Likewise the notches of all the five notch paddles align. As FIGS. 1 and 3 illustrate, however, the four notches are not aligned with the five notches on the succeeding and preceding five notch paddles. One purpose for the non-alignment is to prohibit any grain and debris from becoming stationary upon the screen 13. As the endless chain shown in FIG. 4 causes the paddles 16 and 17 to sweep along and against the primary screen 13 the grain and debris are forced to move forward as well as across the screen 13 due to the misalignment of the notches. Such movement of the debris and grain provides an effective sieving action assuring that the grain will fall through the screen's holes and not be carried along with the larger debris and subsequently lost out the discharge outlet 32. With the sweeping action the grain falls through the primary screen's holes 33 to the fine screen 14 below prior to reaching the overs discharge end 26 and thereby is not lost out the discharge outlet 32 with the larger debris.

As already noted, the paddles 16 and 17 are attached at both their individual ends to an endless link chain 18. The endless chain 18 provides the means for the paddles 16 and 17 to sweep closely over and against the primary screen 13. Upon reaching the end of the primary screen 13 at the juncture of the main housing unit 11 and the end unit 26, the endless chain 18 moves over and along a sprocket wheel 28 which is attached to the shaft 27. When a paddle reaches the overs discharge unit 26 the debris it is carrying along will fall freely towards the base of the overs discharge unit 26 at the end of the primary screen 13. At the base of the overs discharge unit 26 is located the overs discharge outlet 32 and the debris falls freely through this opening and is thereby completely separated from the grain.

As the paddles 16 and 17 and chain means 18 pass over and along the sprocket wheels 20 and 25, the paddles become inverted in relation to their orientation on the primary screen.

Thus, on the return trip to the drive means unit 19 end of the machine, the paddles 16 and 17 now act as solid sweeping walls contacting the grain and finer impurities which have fallen from the primary screen 13 above. Either a pan or a fine mesh screen 14 can be utilized in this portion of the main housing unit depending on whether or not fine impurities are to be removed. The paddles 16 and 17 contact the grain and finer impurities in the lower portion and sweep such along and against the pan or secondary screen 14 towards the outlet 24 as shown in FIG. 4. As the paddles carry the grain past the edge of the pan or fine mesh screen 14, the now cleaned grain falls freely out of the apparatus by means of the opening 24 provided at the base of the drive means unit 19.

The drive means unit 19 located at the upper end of the apparatus houses a shaft 21 and sprocket wheels 22 which engage the endless link chains. It is at this end of the apparatus where the motor 23 is located. The motor causes the shaft 21 to rotate which in turn revolves the sprocket wheels 22. With the endless link chains positioned along the sprocket wheels as shown in FIG. 4 the chains are driven and the paddles then move over the screens as described above. It is in the drive means unit 19 that the orientation of the paddles is again reversed and the notched portion of a paddle becomes the edge contacting the primary screen as the intake area is reached, and the cleaning process is repeated.

It will be readily observed by those skilled in the art that many other embodiments and modifications are possible that do not depart from the invention disclosed above or claimed hereafter.

I claim:

1. A method of scalping and cleaning grain wherein a rough grain product is processed into an intermediate grain product and then into a finished grain product, said rough grain product being comprised of a multitude of grain particles, a multitude of large impurities and a multitude of small impurities, said large impurities being of a larger diameter than said grain particles and said grain particles being of a larger diameter than said small impurities, said intermediate grain product being comprised of said grain particles and said small impurities, and said finished grain product being comprised of said grain particles, comprising the steps of:

(a) placing said rough grain product on an overs screen having a multitude of first openings, said first openings having a diameter which is larger than said grain particles and said small impurities, but smaller than said large impurities;

(B) moving said rough grain product relative to said overs screen by the use of a grain movement means, said grain movement means including a driving means driveably connected to a first end and a second end and grain movement members driveably connected to said first end and said second end, each of said grain movement members comprising an elongate flat paddle having a first elongate edge and a second elongate edge opposite said first elongate edge, said first elongate edge including a plurality of notches, said notched paddles consisting of a number of first notched paddles and a complimentary number of second notched paddles, said notches of said first notched paddles not being aligned with said notches of said second notched paddles, said first notched paddles and said second notched paddles being driveably connected to said first end and said second end in an alternating manner so that said first notched paddles pass over said overs screen immediately in front of and immediately behind said second notched paddles and said second notched paddles pass over said overs screen immediately in front of and immediately behind said first notched paddles;

(c) allowing said grain particles and said small impurities to fall through said first openings of said overs screen and fall against an unders screen having a multitude of openings of a smaller diameter than said grain particles but of a larger diameter than said small impurities;

(d) moving said small impurities and said grain particles, comprising said intermediate grain product relative to said unders screen by the use of said second elongate edges of said first and second notch paddles, said elongate edges being solid straight edges;

(e) allowing said small impurities to fall through said unders screen;

(f) removing said grain particles comprising a finished grain product through a finished grain product discharge means.

2. A grain scalping and cleaning apparatus for processing a rough grain product into an intermediate grain product, said rough grain product being comprised of a multitude of grain particles, a multitude of large impurities, and a multitude of small impurities, said intermediate grain product being comprised of said small impurities and said grain particles, said large impurities having a larger diameter than said grain particles and said small impurities, wherein said grain scalping and cleaning apparatus removes said large impurities from said rough grain product to yield said intermediate grain product, comprising:

(a) a housing means;

(b) a first screen means affixed to said housing means, said first screen means having a multitude of openings, said openings being of a diameter which is smaller than said large impurities, but larger than said grain particles and said small impurities;

(c) a surface means affixed to said housing means below said first screen means;

(d) an inlet means provided in said housing means for allowing said rough grain product to be deposited on a portion of a said first screen means;

(e) a large impurities discharge means provided in said housing means to permit said large impurities to be discharged from said housing means;

(f) an intermediate grain product discharge means to permit said intermediate grain product comprised of said grain particles and said small impurities to be discharged from said housing means;

(g) a grain movement means for moving said rough grain product relative to said first screen means, said grain movement means thereby assisting said small impurities and said grain particles to pass through said first screen means and collect upon said surface means, said grain particles and said small impurities comprising said intermediate grain product while lying upon said surface means, said large impurities being unable to pass through said first screen means and being discharged by said grain movement means through said large impurities discharge means, said grain movement means also moving said intermediate grain product relative to said surface means and discharging said intermediate grain product through said intermediate grain product discharge means, said grain movement means including a driving means and a first end and a second end drivably connected to said driving means, and a number of grain movement members drivably connected to said first end and said second end, said grain movement members moving said rough grain product relative to said first screen means, and said grain movement members then inverting to move said intermediate grain product relative to said surface means.

3. The grain scalping and cleaning apparatus of claim 1 wherein said housing means is provided in a number of different lengths to house and clean different volumes of said rough grain product.

4. The grain scalping and cleaning apparatus of claim 1 wherein said housing means comprises a number of elongate units having an overall length, and wherein the number of said elongate units can be varied to vary said overall length to house and clean different volumes of said rough grain product.

5. The grain scalping and cleaning apparatus of claim 1 wherein said grain movement members move said rough grain product in a first direction relative to said first screen means and said grain movement members move said intermediate grain product in a second direction relative to said surface means, said first direction being towards said second end and away from said first end, and said second direction being toward said first end and away from said second end.

6. The grain scalping and cleaning apparatus of claim 5 wherein said first end comprises a driving end and said second ends comprises a driven end.

7. The grain scalping and cleaning apparatus of claim 6 wherein each of said grain movement members is an elongate flat paddle.

8. The grain scalping and cleaning apparatus of claim 7 wherein said elongate paddles have a first elongate edge and a second elongate edge opposite said first elongate edge, said first elongate edge having a plurality of notches and said second elongate edge being a substantially straight solid edge.

9. The grain scalping and cleaning apparatus of claim 8 wherein said notched paddles consist of a number of first notched paddles and a complimentary number of second notched paddles, said notches of said first notched paddles not be aligned with said notches of said second notched paddles, said first notched paddles and said second notched paddles being connected to said driving end and said driven end in such a way as to alternate so that said first notched paddles will move across said first screen means and said surface means immediately in front of and immediately behind said second notched paddles, and so that said second notched paddles move across the first screen means and said surface means immediately in front of and immediately behind said first notched paddles.

10. The grain scalping and cleaning apparatus of claim 9 wherein said grain movement means simultaneously moves said rough grain product relative to said first screen means and said intermediate grain product relative to said surface means.

11. The grain scalping and cleaning apparatus of claim 10 wherein said driving end includes a first sprocket shaft assembly and said driven end includes a second sprocket shaft assembly, and said first and said second notched paddles have a first end and a second end opposite said first end, each of said first and said second notched paddles being operably affixed at said first end to a first endless chain and at said second end to a second endless chain, said first and said second endless chains being operably affixed to said first and second sprocket shaft assemblies.

12. The grain scalping and cleaning apparatus of claim 11 wherein said first notched paddles have four of said notches and said second notched paddles have five of said notches.

13. The grain scalping and cleaning apparatus of claim 12 further comprising an adjustable bearing plate operably connected to said second sprocket shaft assembly, said adjustable bearing plate permitting said second sprocket shaft assembly to be moved translationally with respect to said first sprocket shaft assembly in order to vary the tension forces in said first and said second endless chains.

14. The grain scalping and cleaning apparatus of claim 13 wherein said housing means includes a removable portion to permit access to said first and said second screen means for removal and replacement, or maintenance and repair.

15. A grain scalping and cleaning apparatus for processing a rough grain product into an intermediate grain product and then into a finished grain product, said rough grain product being comprised of a multitude of grain particles, a multitude of large impurities and a multitude of small impurities, said intermediate grain product being comprised of said small impurities and said grain particles, and said finished grain product being comprised of said grain particles, wherein said grain scalping and cleaning apparatus first removes said large impurities from said rough grain product to yield said intermediate grain product and next removes said small impurities from said intermediate grain product to yield said finished grain product, said large impurities having a larger diameter than said grain particles, and said grain particles having a larger diameter than said impurities, comprising:

(a) a housing means;

(b) a first screen means affixed to said housing means, said first screen means having a multitude of first openings, said first openings having a diameter which is smaller than said large impurities but larger than said grain particles and said small impurities;

(c) a second screen means affixed to said housing means below said first screen means, said second screen means having a multitude of second openings, said second opening having a diameter which is smaller than said grain particles but larger than said small impurities;

(d) an inlet means provided in said housing means for allowing said rough grain product to be deposited on a portion of said first screen means;

(e) a large impurities discharge means provided in said housing means to permit said large impurities to be discharged from said housing means;

(f) a small impurities discharge means provided in said housing means to permit said small impurities to be discharged from said housing means;

(g) a finished grain product discharge means to permit said finished grain product comprised of said grain particles to be discharged from said housing means;

(h) a grain movement means for moving said rough grain product relative to said first screen means, said grain movement means thereby assisting said small impurities and said grain particles to pass through said first screen means and collect upon said second screen means where said grain particles and said small impurities lie upon said second screen means to comprise said intermediate grain product, said large impurities being unable to pass through said first screen means and being discharged by said grain movement means through said large impurities discharge means, said grain movement means also moving said intermediate grain product relative to said second screen means and thereby assisting said small impurities to pass through said second screen means, said grain particles being unable to pass through said second screen means, said grain particles comprising said finished grain product and being discharged by said grain movement means through said finished grain product discharge means, said grain movement means including a first end and a second end and a driving means driveably connected to said first end and said second end, and a number of grain movement members driveably connected to said first and second end, said grain movement members moving said rough grain product relative to said first screen means and then inverting to move said intermediate grain product relative to said second screen means.

16. The grain scalping and cleaning apparatus of claim 15 wherein said housing means is provided in a number of different lengths to house and clean different volumes of said rough grain product.

17. The grain scalping and cleaning apparatus of claim 15 wherein said housing means comprises a number of elongate units having an overall length, and wherein the number of said elongate units can be varied to vary said overall length to house and clean different volumes of said rough grain product.

18. The grain scalping and cleaning apparatus of claim 15 wherein said grain movement members move said rough grain product in a first direction relative to said first screen means and said grain movement members move said intermediate grain product in a second direction relative to said second screen means, said first direction being towards said second end and away from said first end, and said second direction being toward said first end and away from said second end.

19. The grain scalping and cleaning apparatus of claim 18 wherein said first end comprises a driving end and said second ends comprises a driven end.

20. The grain scalping and cleaning apparatus of claim 19 wherein each of said grain movement members is an elongate flat paddle.

21. The grain scalping and cleaning apparatus of claim 20 wherein said elongate paddles have a first elongated edge and a second elongate edge opposite said first elongate edge, said first elongate edge having a plurality of notches and said second elongate edge being a substantially straight solid edge.

22. The grain scalping and cleaning apparatus of claim 21 wherein said notched paddles consist of a number of first notched paddles and complimentary number of second notched paddles, said notches of said first notched paddles not be aligned with said notches of said second notched paddles, said first notched paddles and said second notched paddles being connected to said driving end and said driven end in such a way as to alternate so that said first notched paddles will move across said first screen means and said second screen means immediately in front of and immediately behind said second notched paddles, and so that said second notched paddles move across the first screen means and said second screen means immediately in front of and immediately behind said first notched paddles.

23. The grain scalping and cleaning apparatus of claim 22 wherein said grain movement means simultaneously moves said rough grain product relative to said first screen means and said intermediate grain product relative to said second screen means.

24. The grain scalping and cleaning apparatus of claim 23 wherein said driving end includes a first sprocket shaft assembly and said driven end includes a second sprocket shaft assembly, an said first and said second notched paddles have a first end and a second end opposite said first end, each of said first and said second notched paddles being operably affixed at said first end to a first endless chain and at said second end to a second endless chain, said first and said second endless chains being operably affixed to said first and second sprocket shaft assemblies.

25. The grain scalping and cleaning apparatus of claim 24 wherein said first notched paddles have four of said notches and said second notched paddles have five of said notches.

26. The grain scalping and cleaning apparatus of claim 25 further comprising an adjustable bearing plate operably connected to said second sprocket shaft assembly, said adjustable bearing plate permitting said second sprocket shaft assembly to be moved translationally with respect to said first sprocket shaft assembly in order to vary the tension forces in said first and said second endless chains.

27. The grain scalping and cleaning apparatus of claim 26 wherein said housing means includes a removable portion to permit access to said first and said second screen means for removal and replacement or maintenance and repair.

* * * * *

UNITED STATES PATENT AND TRADEMARK OFFICE

CERTIFICATE OF CORRECTION

PATENT NO. : 4,177,900

DATED : December 11, 1979

INVENTOR(S) : Eldon R. Kluthe

It is certified that error appears in the above—identified patent and that said Letters Patent is hereby corrected as shown below:

Column 2, line 63, delete "with".
Column 3, line 33, After "control", add --of--;
Column 3, line 40, "fice" should read --five--;
Column 3, line 48, "selections" should read --sections--.
Column 7, line 51, numeral "1" should read --2--;
Column 7, line 55, numeral "1" should read --2--;
Column 7, line 61, numeral "1" should read --2--.

Signed and Sealed this

*Twenty-fifth* Day of *March 1980*

[SEAL]

*Attest:*

SIDNEY A. DIAMOND

*Attesting Officer*

*Commissioner of Patents and Trademarks*